United States Patent [19]

Hackett et al.

[11] 4,011,031

[45] Mar. 8, 1977

[54] ROTOR CONSTRUCTIONS FOR SLANT AXIS ROTARY MECHANISMS

[75] Inventors: David E. Hackett, Washington; Paul J. Staebler, Dunlap, both of Ill.

[73] Assignee: Caterpillar Tractor Co., Peoria, Ill.

[22] Filed: Apr. 9, 1976

[21] Appl. No.: 675,359

[52] U.S. Cl. ..... 418/53; 418/94

[51] Int. Cl.[2] ..... F01C 1/02; F01C 21/06

[58] Field of Search ..... 418/49, 50, 51, 52, 418/53, 91, 94

[56] References Cited

UNITED STATES PATENTS

| | | | |
|---|---|---|---|
| 410,308 | 9/1889 | Bowns | 418/53 |
| 442,401 | 12/1890 | Shaw | 418/53 X |
| 1,638,183 | 8/1927 | Bylger | 418/53 X |
| 3,549,286 | 12/1970 | Moriarty | 418/94 X |
| 3,972,657 | 8/1976 | Clarke et al. | 418/53 |
| 3,982,861 | 9/1976 | Gibson | 418/53 |

*Primary Examiner*—Carlton R. Croyle
*Assistant Examiner*—Leonard Smith
*Attorney, Agent, or Firm*—Wegner, Stellman, McCord, Wiles & Wood

[57] ABSTRACT

An improved slant axis rotary mechanism including a housing defining a chamber, a shaft journalled in the housing and having an angular eccentric within the chamber and a rotor within the chamber and journalled on the eccentric. The eccentric includes a radially outwardly extending thrust collar located between the ends of the eccentric. The rotor includes a hub and a peripheral flange and is defined by a centerpiece including the flange and part of the hub and having a bearing pad embracing one side of the thrust collar. An intermediate piece is secured to the centerpiece on one side thereof and has a bearing pad embracing the other side of the thrust collar. A pair of covers each defining part of the hub, are respectively secured to the centerpiece and to the intermediate piece and partially cover the latter.

10 Claims, 4 Drawing Figures

ROTOR CONSTRUCTIONS FOR SLANT AXIS ROTARY MECHANISMS

BACKGROUND OF THE INVENTION

This invention relates to slant axis rotary mechanisms employed as engines, pumps, compressors, or the like. More specifically, it relates to improvements in rotor constructions for such mechanisms.

Rotor construction in slant axis rotary mechanisms is relatively complex due to the number of constraints requiring simultaneous satisfaction. For example, in a slant axis rotary engine, the rotor must be well cooled while at the same time sufficiently rigid as to not deflect appreciably to thereby maintain high compression ratios. The rotor must be easy to assemble which, in a practical sense, requires that it utilize common fastener technology. Simultaneously, the split lines between the parts must not interfere with the assembly of seals carried by the hub or flange, and grooves or bores for receiving the seals must be located so as to be relatively easy to machine.

Conventionally, the approach to rotor fabrication wherein it is attempted to optimize each of the above requirements, includes the fabrication of the main body and a threaded retainer threadably received in the main body. The main body carries one side of the hub as well as the rotor flange. It additionally carries part of the opposite hub side while the retainer carries the remainder of that hub side. The hubs are, of course, spherical and require the presence of grooves to carry hub seals. If relatively fine threads are employed at the interface of the main body and the threaded retainer, insufficient strength is present. Conversely, if coarse threads are employed, assembly torque is high and it is difficult to obtain a precise desired torque during assembly.

Moreover, the hub seal grooves on the main body and the threaded retainer must intersect at very precise locations, the high assembly torque makes it difficult to properly orient the threaded retainer on the main body so as to achieve proper alignment. Similarly, bearing clearances are difficult to control because of the large torques involved during assembly.

SUMMARY OF THE INVENTION

It is a principal object of the invention to provide a new and improved slant axis rotary mechanism. More specifically, it is an object of the invention to provide a new and improved rotor construction for use in slant axis rotary mechanisms.

An exemplary embodiment of the invention achieves the foregoing object in a construction including a housing defining a chamber. A shaft is journalled in the housing and includes an angular eccentric within the chamber. The eccentric is provided with a radially outwardly extending thrust collar between its ends and a rotor is within the chamber and journalled on the eccentric. The rotor includes a hub having a peripheral flange and is defined by a centerpiece including the flange and part of the hub. The centerpiece also has a bearing pad embracing one side of the thrust collar. An intermediate piece is secured to the centerpiece on one side thereof and has a bearing pad embracing the other side of the thrust collar. A pair of covers is provided, each defining part of the hub, with one secured to the centerpiece and the other secured to and covering the intermediate piece.

According to a highly preferred embodiment, the center and intermediate pieces each carry a journal bearing engaging the eccentric. The journal bearing carried by one piece engages the eccentric on a side of the thrust collar opposite from the side of the eccentric engaged by the journal bearing carried by the other piece. Preferably, the covers and the pieces are secured together by a plurality of relatively small threaded fasteners, whereby assembly torque may be easily controlled.

In order to insure good cooling, the centerpiece preferably includes plural, angularly spaced coolant receiving cavities and means are provided for directing coolant to the cavities. In addition, the intermediate piece includes plural coolant receiving cavities aligned with corresponding ones of the cavities in the centerpiece and means are provided for establishing fluid communication between the aligned ones of the cavities.

In a highly preferred embodiment, the coolant directing means comprises an oil conduit in the shaft and adapted to receive oil under pressure. Oil ports are located in the eccentric and are in fluid communication with the conduit for directing oil into the cavities. The cavities include a passage opening to the thrust collar and the oil ports preferably are located in the thrust collar. Passages are located in the centerpiece and extend between adjacent ones of the cavities so that coolant, normally oil, may pass from one cavity to another circumferentially. Finally, each cavity includes a drain passage to the eccentric.

Other objects and advantages will become apparent from the following specification taken in conjunction with the accompanying drawings.

DESCRIPTION OF THE PREFERRED EMBODIMENT

Figure 1:
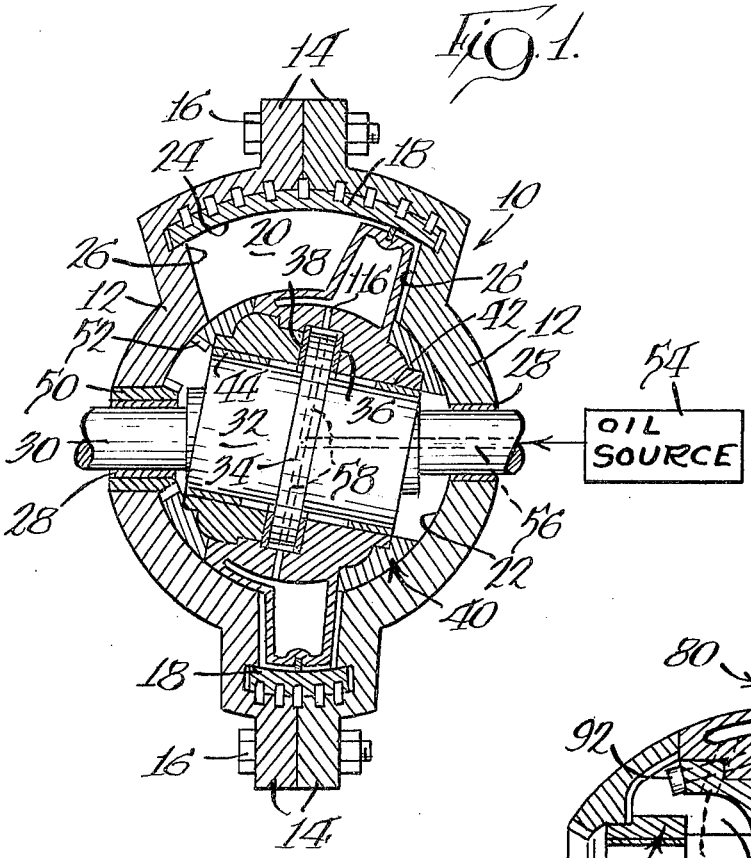
FIG. 1 is a sectional view of a slant axis rotary mechanism made according to the invention.

An exemplary embodiment of a slant axis rotary mechanism made according to the invention is illustrated in FIG. 1 in the form of a four-cycle slant axis rotary engine. However, it is to be understood that the invention is not restricted to slant axis rotary mechanisms employed as engines, but will find utility in such mechanisms used as pumps, compressors, or the like. Similarly, it is to be understood that the invention has utility in mechanisms other than those working on the four-cycle principle as, for example, two-cycle mechanisms.

An exemplary embodiment of a slant axis rotary mechanism made according to the invention includes a housing, generally designated 10, defined by opposed, clam-like end housings 12, each having a peripheral flange 14 for receipt of clamping means, as bolts 16, whereby the two are secured together. An intermediate housing member 18 in the form of a replaceable liner is secured in place between the end housings 12 when the two are clamped together and together with the end housings 12 define an operating chamber 20 for the mechanism. The chamber 20 includes a radially inner spherical surface 22 formed in the end housings 12 and a radially outer spherical surface 24 defined by the liner 18. The end housings 12 also carry opposed, generally radially extending side walls 26.

Bearings 28 in the end housings 12 journal a shaft 30 such that an angular eccentric 32 thereon is disposed within the chamber 20. The eccentric 32 includes a peripheral, radially outwardly extending thrust collar 34 which is disposed between thrust bearing pads 36 and 38 carried by a rotor, generally designated 40, disposed within the chamber 20 and journalled on the eccentric 32 by journal bearings 42 and 44.

A timing gear 50 is carried by the housing 10 and is in mesh with an internal ring gear 52 formed in one end of the rotor 40, as will be described in greater detail hereinafter.

A pressurized oil source, shown schematically at 54, is in fluid communication with an axial bore 56 in the shaft 30 to provide pressurized oil thereto. The oil acts both as a lubricant and as a coolant, as will be described.

Plural, radially extending bores 58 in the eccentric, and preferably aligned with the thrust collar 34 and emerging from the radially outer periphery thereof as oil ports are in fluid communication with the bore 56. As a result, when oil is fed to the bore 56, it will emerge from plural oil ports at the periphery of the thrust collar 34 for purposes of cooling the rotor 40 in a manner to be seen.

Figure 2:
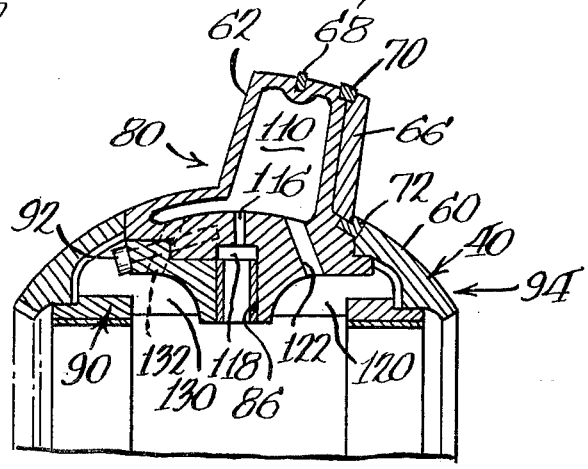
FIG. 2 is an enlarged, fragmentary sectional view of a rotor of a slant axis rotary mechanism embodying the invention and taken approximately along the line 2—2 of FIG. 4.
Figure 3:
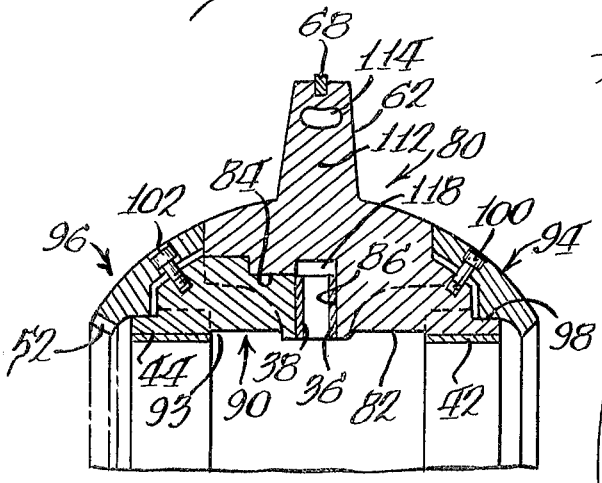
FIG. 3 is a sectional view taken approximately along the line 3—3 of FIG. 4.
Figure 4:
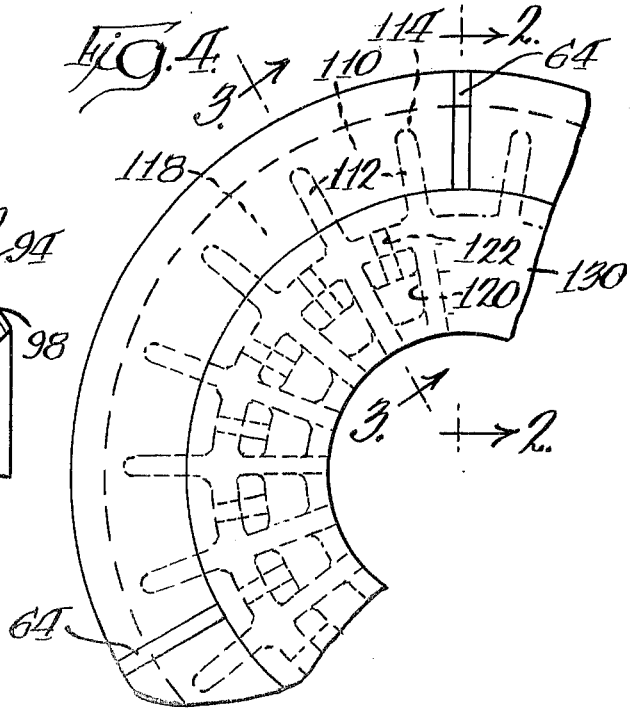
FIG. 4 is an enlarged, fragmentary end view of a rotor embodying the invention.

Turning now to FIGS. 2–4, the rotor 40 includes a generally spherical hub 60 and a peripheral, generally radially outwardly extending flange 62. As is well known, the flange varies in width about its periphery. In a four-cycle engine, for example, each side of the flange has three valleys between three equally angularly spaced apices 64. The apices on one side of the flange are staggered with respect to the other. At each apex 64, there is provided an apex seal 66 which engages a corresponding one of the side walls 26.

The radially outer periphery of the flange 62 carries so-called peripheral seals 68, which sealingly engage the radially outer spherical wall 24. In addition, at each apex seal 66, there is provided a so-called "bolt" or piston seal 70 on the periphery of the flange 62 as well as a similar bolt 72 on the hub 60. Finally, while not shown in the drawing, the hub 60 carries compression seals and oil seals which sealingly engage the radially inner spherical wall 22. One embodiment of a rotor made according to the invention includes a centerpiece, generally designated 80, which, as seen in FIGS. 2 and 3, includes the flange 62 and portions of the hub 60. The centerpiece 80 includes an interior bore 82 for receipt of the eccentric 32, including an enlarged diameter portion 84 of a diameter just slightly greater than that of the thrust collar 34 so as to enable the centerpiece 80 to be assembled thereon. The step 86 between the bore 82 and the enlarged diameter portion 84 carries the thrust bearing pad 36. In addition, the bore 82 carries the journal bearing 42 as well.

The rotor 40 also includes an intermediate piece, generally designated 90, which, as seen in FIG. 2, is secured to the centerpiece 80 within the enlarged diameter portion 84 by means of a plurality of angularly spaced cap screws 92 (only one of which is shown). The intermediate piece 90, at one end thereof, carries the thrust bearing pad 38 which engages the thrust collar 34 oppositely from the pad 36. In addition, on an interior bore 93 the intermediate piece 90 carries the journal bearing 44.

The rotor 40 is completed by a pair of covers, generally designated 94 and 96, respectively. The cover 94 is received on a pilot 98 on the right-hand side of the centerpiece 80 and completes the hub on that side of the rotor. The cover 94 is secured to the centerpiece 80 by a plurality of cap screws 100 which are angularly spaced about the periphery of the rotor. The same are also recessed in the piece 94 as illustrated in FIG. 3 to avoid interference with the radially inner spherical wall 22.

The cover 96 includes the internal ring gear 52 at one end thereof and is secured to the intermediate piece 90 by a series of angularly spaced cap screws 102, similar to the cap screws 100.

It will be seen from FIG. 3 that portions of the covers 94 and 96 are spaced from the remainder of the rotor and that the centerpiece 80 is provided with flat turns of planes at each end which serve as stops for the respective covers. If desired, pilots for the cover pieces may be employed as desired.

With reference to FIGS. 2 and 4, the centerpiece 80 includes a plurality of angularly spaced coolant receiving cavities 110. The same are separated from each other by generally radially extending webs 112 and near the radially outer ends of the webs 112, there are disposed passages 114 (FIGS. 3 and 4) whereby fluid communication between adjacent ones of the cavities 110 is established.

As seen in FIG. 2, the centerpiece 80, adjacent the step 86, includes a plurality of radially extending passages 116, one for each of the cavities 110. It will be recalled that the radially extending conduits 58 in the thrust collar 34 terminate in oil ports at the periphery of the latter and thus, pressurized oil will fill an annular oil gallery 118 defined by the radially outer portions of the step 86 and the thrust collar 34. From the gallery 118, oil will enter the cavities 110 to serve as a coolant via the passages 116 and, in addition, will pass through the clearances between the thrust collar 34 and thrust bearing pads 36 and 38 to lubricate the thrust bearing. The presence of the passages 114 allows the coolant to pass circumferentially from one cavity 110 to another during operation of the mechanism.

Adjacent the right side of the centerpiece 80 and radially inwardly of the flange thereof is a plurality of cavities 120, one corresponding to each of the cavities 110 and aligned therewith. A drain conduit 122 extends from each cavity 110 to the corresponding cavity 120, as best seen in FIG. 2, so that the coolant may drain from the cavity 110 to the area of the eccentric via the passage 122 and the cavity 120. Oil received in the cavity 120, by reason of the configuration of the cavity 120, will serve to cool the right-hand hub area and, specifically, the cover 94.

The intermediate piece 90 is provided with a plurality of cavities 130, each corresponding into and aligned with a corresponding one of the cavities 110 in the same fashion as the cavities 120. Again, a drain passage 132 is established from each of the cavities 110 to the corresponding cavity 130 to direct cooling oil to the cavity 130 for the purpose of cooling the cover 96 and directing the coolant to the eccentric.

From the foregoing, it will be appreciated that the various objects or constraints mentioned previously are satisfied in a rotor made according to the present invention. It will also be appreciated that by reason of the presence of the internal ring gear 52 on the cover 96, heat treatment of the latter is facilitated. Similarly, the machining of grooves and bores for hub and piston seals in the hub is facilitated by reason of the multi-part fabrication of the rotor. For further details of a preferred configuration of hub seal grooves and bores, reference may be had to the commonly assigned, copending applicaton of Myron R. Gibson, entitled "Rotor Construction For Slant Axis Rotary Mechanisms", filed Dec. 12, 1975, Ser. No. 640,083, now U.S. Pat. 3,982,861 the details of which are herein incorporated by reference.

What is claimed is:

1. In a slant axis rotary mechanism, the combination of a housing defining a chamber, a shaft journalled in said housing and having an angular eccentric within said chamber, a radially outwardly extending thrust collar on said eccentric between the ends thereof, and a rotor within said chamber and journalled on said eccentric, said rotor having a hub and a peripheral flange and being defined by a centerpiece including said flange and part of said hub and having a bearing pad embracing one side of said thrust collar, an intermediate piece secured to said centerpiece on one side thereof and having a bearing pad embracing the other side of said thrust collar, and a pair of covers, each defining part of said hub, one secured to said centerpiece and the other secured to and covering said intermediate piece.

2. The slant axis rotary mechanism of claim 1 wherein said center and intermediate pieces each further carry a journal bearing engaging said eccentric, the journal bearing carried by said centerpiece engaging said eccentric oppositely of said thrust collar from said journal bearing carried by said intermediate piece.

3. The slant axis rotary mechanism of claim 2 wherein said covers and said pieces are secured together by plural, relatively small threaded fasteners.

4. The slant axis rotary mechanism of claim 1 wherein said centerpiece includes plural, angularly spaced coolant receiving cavities, and means for directing coolant to said cavities.

5. The slant axis rotary mechanism of claim 4 wherein said intermediate piece includes plural coolant receiving cavities aligned with corresponding ones of said cavities in said centerpieces, and means establishing fluid communication between aligned ones of said cavities.

6. The slant axis rotary mechanism of claim 4 further including passages in said centerpiece extending between adjacent ones of said cavities.

7. The slant axis rotary mechanism of claim 4 wherein each said cavity includes a drain passage to said eccentric.

8. The slant axis rotary mechanism of claim 4 wherein said coolant directing means comprises an oil conduit in said shaft adapted to receive oil under pressure, and oil ports opening radially outwardly to said thrust collar and in fluid communication with said conduit for a. directing oil into said cavity to cool the same, and b. provide lubricating oil to said thrust collar and said bearing pads.

9. The slant axis rotary mechanism of claim 4 wherein said coolant directing means comprises an oil conduit in said shaft and adapted to receive oil under pressure and oil ports in said eccentric in fluid communication with said conduit for directing oil into said cavities.

10. The slant axis rotary mechanism of claim 9 wherein each of said cavities includes a passage opening to said thrust collar and said oil ports are in said thrust collar.

* * * * *